US005451194A

United States Patent [19]

Harrigan

[11] Patent Number: 5,451,194

[45] Date of Patent: Sep. 19, 1995

[54] ROLLER SKATE EXERCISE DEVICE

[76] Inventor: Matthew J. Harrigan, 101 W. 27th St., Apt. 2, New York, N.Y. 10001

[21] Appl. No.: 94,231

[22] Filed: Jul. 21, 1993

[51] Int. Cl.[6] ..... A63B 69/18

[52] U.S. Cl. ..... 482/70; 482/51; 482/124

[58] Field of Search ..... 482/121, 122, 123, 124, 482/125, 126, 129, 130, 131, 133, 70, 79, 140; 434/252

[56] References Cited

U.S. PATENT DOCUMENTS

| | | | |
|---|---|---|---|
| 2,760,774 | 8/1956 | Perez | 482/79 |
| 3,941,377 | 3/1976 | Lie | 272/57 B |
| 4,434,981 | 3/1984 | Norton | 272/97 |
| 4,492,376 | 1/1985 | Schatz et al. | 482/129 |
| 4,659,077 | 4/1987 | Stropkay | 272/97 |
| 4,960,276 | 10/1990 | Fener | 272/97 |
| 4,968,028 | 11/1990 | Wehrell | 482/124 |
| 5,000,442 | 3/1991 | Dalebout | 272/70 |
| 5,039,088 | 4/1990 | Shifferaw | 272/93 |
| 5,125,650 | 6/1992 | Paris | 482/140 |
| 5,125,883 | 6/1992 | Shoebrooks | 482/121 |
| 5,203,754 | 4/1993 | Maclean | 482/124 |
| 5,263,863 | 11/1993 | Stefani et al. | 434/252 |

FOREIGN PATENT DOCUMENTS

| | | | |
|---|---|---|---|
| 0008731 | 11/1988 | WIPO | 482/70 |

*Primary Examiner*—Stephen R. Crow
*Attorney, Agent, or Firm*—Robert W. J. Usher

[57] ABSTRACT

A roller skate exercise device is provided which consists of a platform having a top surface to support a pair of roller skates worn by a person. Components are for permitting the roller skates to slide in opposed reciprocatory motions on the top surface of the platform, so as to simulate cross country skiing.

15 Claims, 1 Drawing Sheet

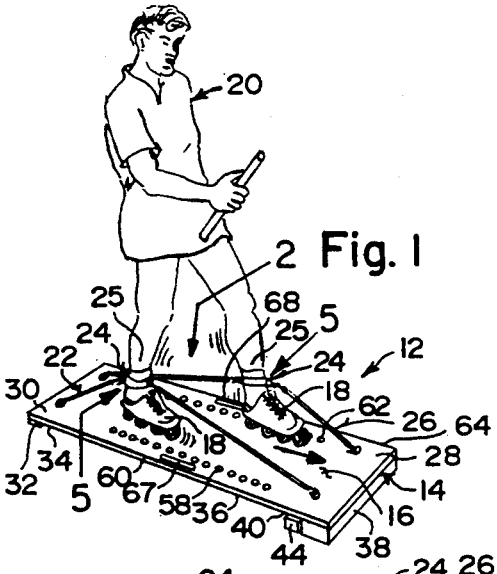
Fig. 1
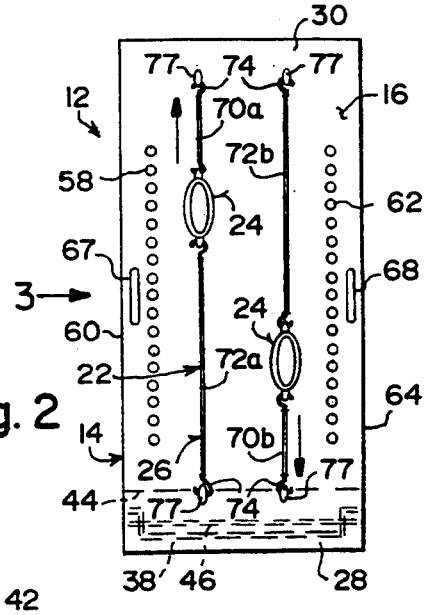
Fig. 2
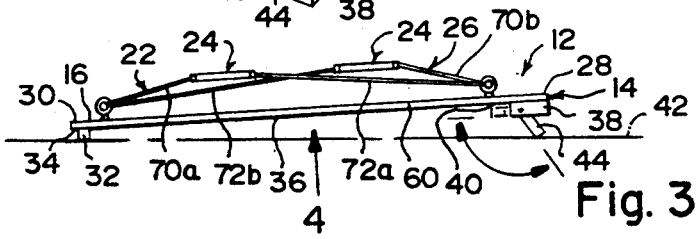
Fig. 3
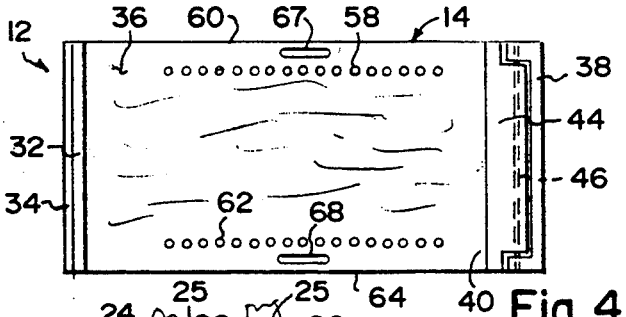
Fig. 4
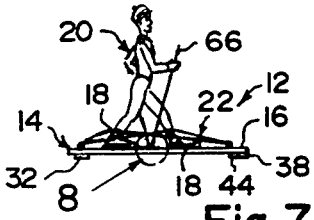
Fig. 7
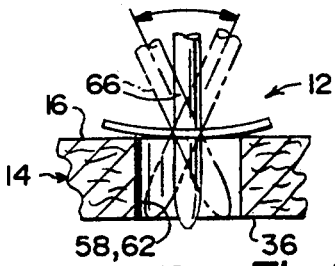
Fig. 8
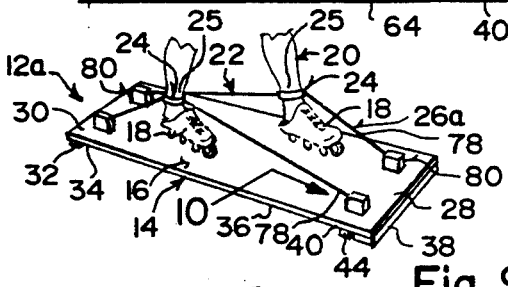
Fig. 9
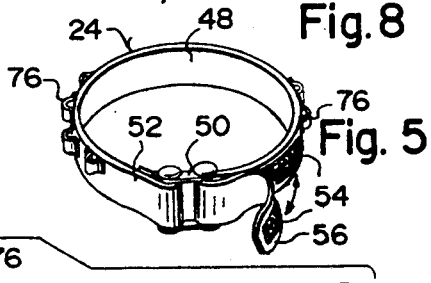
Fig. 5
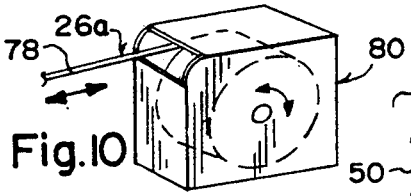
Fig. 10
Fig. 6
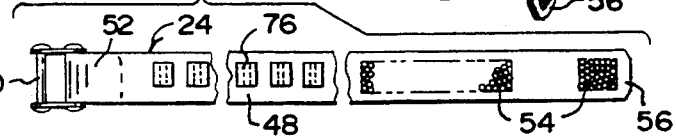

ROLLER SKATE EXERCISE DEVICE

BACKGROUND OF THE INVENTION

The instant invention relates generally to gymnastic equipment and more specifically it relates to a roller skate exercise device.

Numerous types of gymnastic equipment have been provided in prior art that are adapted to have separate foot engaging members reciprocating on parallel guide tracks, so that people using the gymnastic equipment can exercise their legs. For example, U.S. Pat. Nos. 3,941,377 to Lie; 4,434,981 to Norton; 4,659,077 to Stropkay; 4,960,276 to Feuer et al.; 5,000,442 to Dalebout et al. and 5,039,088 to Shifferaw all are illustrative of such prior art. While these units may be suitable for the particular purpose to which they address, they would not be as suitable for the purposes of the present invention as heretofore described.

SUMMARY OF THE INVENTION

A primary object of the present invention is to provide a roller skate exercise device that will overcome the shortcomings of the prior art devices.

Another object is to provide a roller skate exercise device that will simulate the motion of cross country skiing with roller skates, so that a person can work out day and night in the safety of their home to build up their muscles.

An additional object is to provide a roller skate exercise device in which the person can utilize ski poles in conjunction with the device for better balance.

A further object is to provide a roller skate exercise device that is simple and easy to use.

A still further object is to provide a roller skate exercise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a diagrammatic perspective view illustrating the instant invention in use;

FIG. 2 is a top elevational view taken in the direction of arrow 2 in FIG. 1;

FIG. 3 is a side elevational view taken in the direction of arrow 3 in FIG. 2;

FIG. 4 is a bottom elevational view taken in the direction of arrow 4 in FIG. 3;

FIG. 5 is an enlarged diagrammatic perspective view of one of the ankle straps of the instant invention indicated by arrow 5 in FIG. 1;

FIG. 6 is a diagrammatic top elevational view with parts broken away of the ankle strap spread out flat;

FIG. 7 is a reduced diagrammatic side elevational view illustrating the instant invention being used with ski poles;

FIG. 8 is an enlarged diagrammatic cross sectional view of the area indicated by arrow 8 in FIG. 7, illustrating the cooperation between the ski pole and one of the holes in the platform of the instant invention;

FIG. 9 is a diagrammatic perspective view illustrating a second embodiment of the instant invention; and FIG. 10 is an enlarged diagrammatic perspective view illustrating the reel tension assembly as indicated by arrow 10 in FIG. 9.

DETAILED DESCRIPTION OF THE PREFERRED EMBODIMENTS

Turning now descriptively to the drawings, in which similar reference characters denote similar elements throughout the several views, FIGS. 1 through 10 illustrate a roller skate exercise device 12, which consists of a platform 14 having a top surface 16 to support a pair of roller skates 18 worn by a person 20. Components 22 are for permitting the roller skates 18 to slide in opposed reciprocating motions on the top surface of the platform 14, so as to simulate cross country skiing.

The slide permitting components 22 include a pair of straps 24, in which each strap 24 fits about an ankle 25 of the person 20. Elements 26 are for applying resistance to the straps 24 between a front portion 28 and a rear portion 30 of the top surface 16 of the platform 14.

A first cross support 32 is mounted to a rear portion 34 of a bottom surface 36 of the platform 14. A second cross support 38 is mounted to a front portion 40 of the bottom surface 36 of the platform 14. The first cross support 32 and the second cross support 38 can horizontally elevate the platform 14 from a floor 42. A fold out leg 44 is hinged at 46 to the second cross support 38, so that the fold out leg 44 can angularly elevate the platform 14 from the floor 42.

As best seen in FIGS. 5 and 6, each strap 24 is adjustable and contains a belt portion 48 with a buckle 50 attached to a first end 52 of the belt portion 48. Mating hook and loop pile fasteners 54 are attached to a second end 56 of the belt portion 48. The second end 56 can fit through the buckle 50 and be folded over to be held thereto by the mating hook and loop pile fasteners 52.

The platform 14 can have a first set of spaced apart holes 58 in a parallel arrangement along a first side 60 and a second set of spaced apart holes 62 in a parallel arrangement along a second side 64. The person 20 can use a pair of ski poles 66 inserted into two holes 58, 62 for better balance. The platform 14 can also have a first handle slot 67 between the first set of spaced apart holes 58 and the first side 60 and a second handle slot 68 between the second set of spaced apart holes 62 and the second side 64, so that the platform 14 can be carried by the handles slots 67 and 68.

The resistance applying elements 26 in FIGS. 1 through 3, are a pair of short elastic resistance cords **70*a*, 70*b*. The first short cord 70*a* is connected between the first strap 24 and the front portion 30 of the first strap 24 and the front portion 30 of the top surface 16 of the platform 14. The second short cord 70*b* is connected between the second strap 24 and the rear portion 28 of the top surface 16 of the platform 14. A pair of long elastic resistance cords 72*a*, 72*b* are also provided. The first long cord 72*a* is connected between the first strap 24 and the rear portion 28 of the top surface 16 of the platform 14. The second long cord 72*b* is connected between the second strap 24 and the front portion 30 of the top surface 16 of the platform 14**.

A hook 74 is attached to each end of the short cords **70*a*, 70*b* and the long cords 72*a*, 72*b***. Each belt portion 48, as best seen in FIGS. 5 and 6, has at least two loops 76 formed thereon. One loop 76 will receive one hook 74 from the short cord 70*a*, 70*b*, while the other loop 76 will receive another hook 74 from the long cord 72*a*, 72*b*.

Four eyelet screws 77 are threaded in spaced apart relationships transversely into the front portion 28 of the top surface 16 of the platform 14. The third and fourth eyelet screws 77 are threaded in spaced apart relationships transversely into the rear portion 30 of the top surface 16 of the platform 14. The eyelet screws 77 will receive the hooks 74 from the short cords 70*a*, 70*b* and the long cords 72*a*, 72*b*.

A modified roller skate exercise device 12*a*, as shown is FIG. 9. The resistance applying elements 26*a* include four elongate nonelastic resistance cords 78. The first and second cords 78 are each connected between one strap 24 and a front portion 28 of the top surface 16 of the platform 14. The third and fourth cords 78 are each connected between one strap 24 and a rear portion 30 of the top surface 16 of the platform 14.

Four reel tension assemblies 80 are also provided, one of which is best seen in FIG. 10. The first and second reel tension assemblies 80 are mounted in spaced apart relationships transversely onto the front portion 28 of the top surface 16 of the platform 14. The third and fourth reel tension assemblies 80 are mounted in spaced apart relationships transversely onto the rear portion 30 of the top surface 16 of the platform 14. The reel tension assemblies 80 will store therein and dispense therefrom the cords 78.

OPERATION OF THE INVENTION

To use the roller skate exercise device 12 the person 20 wearing the roller skates 18 steps onto the top surface 16 of the platform 14, with the straps 24 attached to his/her ankles. The resistance cords 78 or 70*a*, 70*b*, 72*a*, and 72*b* are then attached to the straps 24. The roller skates 18 can now slide in opposed reciprocating motions on the top surface 16 of the platform 14, to simulate cross country skiing. The ski poles 66 can each be inserted into one hole 58, 62 in the platform 14, so that the person 20 can have better balance.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A roller skate exercise device which comprises: a pair of roller skates, a platform having a top surface to support the pair of roller skates worn by a person; and for permitting the roller skates to be rolled by the person in opposed reciprocating motions on said top surface of said platform; and, means for resisting the motions of the roller skates including tie means attached adjacent the ankles of the person and to the platform thereby to increase substantially the effort of the person.

2. A roller skate exercise device as recited in claim 1, wherein said tie means comprise a first short cord connected between said first strap and a front portion of said platform, a second short cord connected between said second strap and a rear portion of said platform, a first long cord connected between said first strap and said rear portion of said platform, and a second long cord connected between said second strap and said front portion of said platform.

3. A roller skate exercise device as recited in claim 1, further including:

a) a first cross support mounted to a rear portion of a bottom surface of said platform;

b) a second cross support mounted to a front portion of said bottom surface of said platform, so that said first cross support and said second cross support can horizontally elevate said platform from a floor; and c) a fold out leg hinged to said second cross support, so that said fold out leg can angularly elevate said platform from the floor.

4. A roller skate exercise device as recited in claim 1, wherein the tie means are attached adjacent the user's ankles by strap means which comprise:

a) a belt portion;

b) a buckle attached to a first end of said belt portion; and c) mating hook and loop pile fasteners attached to a second end of said belt portion, so that said second end can fit through said buckle and folded over to be held thereto by said mating hook and loop pile fasteners.

5. A roller skate exercise device as recited in claim 1, further including said platform having a first set of spaced apart holes in a parallel arrangement along a first side and a second set of spaced apart holes in a parallel arrangement along a second side, so that the person can use a pair of ski poles inserted into said holes for better balance.

6. A roller skate exercise device as recited in claim 5, further including said platform having a first handle slot between said first set of spaced apart holes and said first side and a second handle slot between said second set of spaced apart holes and said second side, so that said platform can be carried by said handle slots.

7. A roller skate exercise device as recited in claim 2, further including:

a) a plurality of hooks, each attached to each end of said short cords and said long cords; and b) each said belt portion having at least two loops formed thereon, in which one said loop will receive one said hook from said short cord, while other said loop will receive another said hook from said long cord.

8. A roller skate exercise device as recited in claim 2, further including four eyelet screws, in which said first and second eyelet screws are threaded in spaced apart relationship transversely into said front portion of said top surface of said platform, while said third and fourth eyelet screws are threaded in spaced apart relationships transversely into said rear portion of said top surface of said platform, whereby said eyelet screws will receive said hooks from said short cords and said long cords.

9. A roller skate exercise device as recited in claim 1 wherein said tie means are elastic resistance cords connected between front and rear portions of said platform.

10. A roller skate exercise device which comprises a pair of roller skates:

a platform having a top surface to support said pair of roller skates worn by a person;

means for permitting the roller skates to be rolled by the person in opposed reciprocating motions on said top surface of said platform comprising:

a pair of straps, in which each strap fits to a person adjacent an ankle; and, means for applying resistance to said straps including four elongate nonelastic resistance cords, in which first and second cords are connected between respective straps of said pair and a front portion of said platform, while third and fourth cords are connected between respective straps of said pair and a rear portion of said platform, and further including four reel tension assemblies, in which a first and a second reel tension assembly are mounted in spaced apart relationships transversely onto said front portion of said platform, while a third and a fourth tension assembly are mounted in spaced apart relationships transversely onto said rear portion of said platform, whereby said tension reel assemblies will store therein and dispense therefrom said cords.

11. A roller skate exercise device as recited in claim 10, further including:

a) a first cross support mounted to a rear portion of a bottom surface of said platform;

b) a second cross support mounted to a front portion of said bottom surface of said platform, so that said first cross support and said second cross support can horizontally elevate said platform from a floor; and c) a fold out leg hinged to said second cross support, so that said fold out leg can angularly elevate said platform from the floor.

12. A roller skate exercise device as recited in claim 10, wherein each said strap is adjustable and includes:

a) a belt portion;

b) a buckle attached to a first end of said belt portion; and c) mating hook and loop pile fasteners attached to a second end of said belt portion, so at said second end can fit through said buckle and folded over to be held thereto by said mating hook and loop pile fasteners.

13. A roller skate exercise device as recited in claim 10, further including said platform having a first set of spaced apart holes in a parallel arrangement along a first side and a second side, so that the person can use a pair of ski poles inserted into said holes for better balance.

14. A roller skate exercise device as recited in claim 10, further including said platform having a first handle slot between said first set of spaced apart holes and said first side and a second handle slot between said second set of spaced apart holes and said second side, so that said platform can be carried by said handle slots.

15. A roller skate exercise device as recited in claim 12 wherein said tie means are elastic resistance cords.

* * * * *